US005358637A

United States Patent [19]

Hutzler et al.

[11] Patent Number: 5,358,637

[45] Date of Patent: Oct. 25, 1994

[54] APPARATUS FOR SORTING AND DEFLAKING FIBROUS SUSPENSIONS

[75] Inventors: Hagen Hutzler, Reutlingen; Erich Czerwoniak, Pfullingen, both of Fed. Rep. of Germany

[73] Assignee: Herman Finckh Maschinenfabrik GmbH & Co., Pfullinggen, Fed. Rep. of Germany

[21] Appl. No.: 512

[22] Filed: Jan. 4, 1993

Related U.S. Application Data

[63] Continuation of Ser. No. 598,618, Oct. 19, 1990, abandoned.

[30] Foreign Application Priority Data

Feb. 18, 1989 [DE] Fed. Rep. of Germany ..... 3904960

[51] Int. Cl.[5] ..... B01D 25/38

[52] U.S. Cl. ..... 210/415; 209/273; 241/74; 241/46.17; 162/55; 162/56

[58] Field of Search ..... 210/414, 415, 298, 299, 210/302; 162/55, 4, 56; 241/74, 46.17; 209/273, 17

[56] References Cited

U.S. PATENT DOCUMENTS

| | | | |
|---|---|---|---|
| 3,411,721 | 11/1968 | Delcellier | 241/46 R |
| 3,437,204 | 4/1969 | Clarke-Pounder | 209/273 |
| 3,637,077 | 1/1972 | Cowan | 209/273 |
| 3,713,536 | 1/1973 | Hooper | 209/273 |
| 3,854,667 | 12/1974 | Baehr | 241/69 |
| 4,043,919 | 8/1977 | Hutzler | 210/415 |
| 4,111,373 | 9/1978 | Holz | 241/46.11 |
| 4,238,324 | 12/1980 | Musselmann | 209/273 |
| 4,275,852 | 6/1981 | Asplund | 241/259.2 |
| 4,941,970 | 7/1990 | Ahs | 241/46.17 |
| 4,991,720 | 2/1991 | Hoglund et al. | 241/46.17 |

FOREIGN PATENT DOCUMENTS

| | | |
|---|---|---|
| 2611886 | 9/1977 | Fed. Rep. of Germany . |
| 3820366 | 1/1989 | Fed. Rep. of Germany . |

*Primary Examiner*—W. Gary Jones
*Assistant Examiner*—Brenda Adele Lamb
*Attorney, Agent, or Firm*—Leydig, Voit & Mayer, Ltd.

[57] ABSTRACT

An appliance for sorting and deflaking fiber suspensions has a rotor with a horizontal axis rotatively mounted in a housing. In a first, inlet rotor zone the rotor is provided with entraining means for extracting by centrifugation contaminating particles of high relative density. The rotor is surrounded donwstream by a screening cylinder and is also provided with entraining means for the fiber suspension, which deflake and sort out the fiber suspension in a second rotor zone. In a third rotor zone the fibers are washed out of the rejects after water has been added and in a fourth zone the rejects are dehydrated.

26 Claims, 3 Drawing Sheets

APPARATUS FOR SORTING AND DEFLAKING FIBROUS SUSPENSIONS

This is a continuation of copending application Ser. No. 07/598,618 filed on Oct. 19, 1990 now abandoned, which claimed priorty under 35 U.S.C. § 120 of International Application PCT/EP90/00199 filed Feb. 7, 1990 which designated the U.S.

The invention relates to an apparatus for sorting and deflaking fibrous suspensions and, in particular, a so-called pressureless sorter for heavily soiled fibrous suspensions such as those resulting as rejected material from the most varied sorting systems.

Known open sorting apparatuses, such as, for example, vibration sorters often used as the final stage in a multistage sorting system, do not generally lead to a rejected material which is dewatered to any great extent and result, in addition, in relatively high losses of usable fibers remaining in the rejected material. The high costs connected with the storage of the rejected material, above all the requirement of a high dry content of the rejected material, often necessitate the purchase of additional apparatus, such as piston-type presses and worm compressors, to further dewater the rejected material in a paper mill.

Known sorting apparatuses comprising a rotor are, however, subject to considerable wear and tear when processing heavily soiled fibrous suspensions, insofar as an apparatus for separating out dirt particles having a heavy specific weight is not connected to their inlet sides. These dirt particles having a heavy specific weight do have an extremely abrasive effect in these apparatuses between rotor and screen.

The object underlying the invention was therefore to provide a sorting apparatus which is also suitable for processing heavily soiled fibrous suspensions and fulfills the requirement for a rejected material which has a high dry content and is as free of fibers as possible.

A sorting apparatus, in which the fiber content of the fibrous suspension to be processed is reduced and which is intended to result in a rejected material having a relatively high dry content, is known from EP-0 235 605-A2. This sorting apparatus has a housing surrounding a rotor with a horizontal axis, the housing having a housing portion on the inlet side with a diameter and a housing portion on the outlet side with a smaller diameter. In the housing portion on the inlet side the rotor comprises a first rotor region which is designed as an impeller having a relatively large diameter and is intended to effect deflaking , whereas a second rotor region located in the housing portion at the outlet side is designed as a cylinder having a considerably smaller diameter and is surrounded by a cylindrical screen, through which the accepted material and the majority of the water pass in order to provide a relatively dry rejected material. A screen plate is located on the side of the impeller opposite the housing portion on the outlet side having a smaller diameter and at a very slight axial distance from the impeller, and is followed by an accepted material chamber provided with an accepted material outlet. If this known apparatus is used for processing fibrous suspensions recovered from mixed waste paper, it is intended to be utilized for the last stage of the sorting process. If it were to form the first stage of the sorting process, the dirt particles, such as sand and metal parts, contained in the fibrous suspension would quickly lead to wear and tear on the impeller, the screen plate, the vanes arranged at the periphery of the second rotor region and the cylindrical screen surrounding the second rotor region.

DE-26 11 886-B of the applicant discloses an apparatus for sorting and deflaking fibrous suspensions, which comprises a housing surrounding a rotor arranged with its axis horizontal, the housing having in a front housing end region an inlet for the fibrous suspension to be processed, in a central region at the bottom an accepted material outlet for the sorted fibrous suspension and in a rear housing end region at the bottom a rejected material outlet. The rotor has the form of a hollow, approximately drum-shaped, rotationally symmetrical body and comprises three regions arranged one behind the other in the direction of the rotor axis, namely a first rotor region on the inlet side, a central, second rotor region and a third .rotor region on the outlet side. Web-like accelerator strips are attached at the rotor periphery in the first and third rotor regions to accelerate the fibrous suspension in the circumferential direction while the second rotor region is provided at the periphery with ribs extending in axial direction, these ribs being designed such that they develop a deflaking effect together with a screen cylinder encircling the rotor at a slight radial distance. Together with this screen cylinder, the first rotor region effects a dewatering of the fibrous suspension while, at the same time, accepted material is separated out. In other words, the first rotor region is a sorting and dewatering region, the second rotor region brings about, as already mentioned, a deflaking of the fibrous suspension, and in the annular space between third rotor region and screen cylinder usable fibers are washed out of the rejected material and sorted, for which purpose a supply of diluting water is directed from outside in radial direction onto the screen cylinder. Behind the rotor the rejected material leaves the apparatus housing through the rejected material outlet already mentioned.

When a fibrous suspension recovered from mixed waste paper is sorted and deflaked with this known apparatus, sand, metal particles and the like result in considerable wear and tear on the screen cylinder and on the accelerator and deflaking ribs attached at the rotor periphery. In addition, this known apparatus supplies an undesirably thin rejected material because in the third rotor region the still usable fibers are washed out of the rejected material by diluting water. The aforementioned object cannot, therefore, be accomplished with this known apparatus.

Proceeding on the basis of an apparatus of the generic type, such as that disclosed in DE-26 11 886-B, i.e. an apparatus for sorting and deflaking fibrous suspensions, comprising a housing which has in a front housing end region an inlet for the fibrous suspension to be processed, in addition an accepted material outlet for the sorted fibrous suspension as well as a rejected material outlet, and in which a rotor having a horizontal axis is mounted for rotation, this rotor having a plurality of regions disposed one after the other in the direction of the rotor axis and being surrounded by annular chambers having different functions, of these regions a first rotor region on the inlet side and a last rotor region facing the rejected material outlet arranged at a rear housing end region being provided at their periphery with take-along elements for the fibrous suspension, the last rotor region being surrounded by an annular screen, and a deflaking rotor region located upstream of the last rotor region having elevations for effecting deflaking , wherein an additional rotor region surrounded by an annular screen is located between said first and said last rotor regions, the object underlying the invention may be accomplished in that the first rotor region is surrounded by an annular housing wall, an outlet for particles of dirt having a heavy specific weight opening into this wall from below, and that the last rotor region is designed as a rejected material thickening region and the additional rotor region is designed as a sorting region. Since, in the inventive apparatus, no screen surrounding the first rotor region has to be provided but rather embodiments are preferred, in which the first rotor region is surrounded by the housing wall which is closed apart from the inlet arranged in the top for the fibrous suspension to be processed and the opening of the outlet for heavy dirt, the dirt particles having a heavy specific weight are, in the inventive apparatus, centrifuged out of the fibrous suspension before they can lead to wear and tear on a screen and the rotor parts surrounded by the screen. The fibrous suspension, which is set to rotate quickly by the rotor, catapults the heavy dirt particles against the housing wall where they slide down along this wall and reach the outlet for the dirt particles having a heavy specific weight. Only then is the fibrous suspension deflaked and sorted in the inventive apparatus. It is hereby considered to be a particular advantage for the processes of sorting and thickening not to occur in the same region of the apparatus because in the sorting region, namely, the screen is appropriately acted upon by wash water to clean the screen and wash out usable fibers whereas in the inventive apparatus the rejected material thickening region need not have any wash water supply device.

In an apparatus of a different generic type for sorting and washing out a fibrous suspension as well as thickening the rejected material (DE-28 50 385-B), a rotor having a more or less horizontal axis is surrounded over its entire length by a screen cylinder. At one end of the apparatus housing which also has a more or less horizontal axis and is approximately cylindrical in design, an inlet for the fibrous suspension to be processed is provided. An outlet for the accepted material is located outside the screen cylinder and at the other end of the apparatus housing a rejected material outlet is provided. A first rotor region on the inlet side is provided with accelerator vanes for the fibrous suspension, a second rotor region with transporting vanes conveying the fibrous suspension in an axial direction and a third rotor region with centrifugal vanes arranged at the rotor periphery. The first rotor region serves to sort the fibrous suspension, the second to wash out the fibrous suspension (by means of wash water outlet openings provided in the rotor casing), and in the third rotor region the rejected material is dewatered. This known apparatus is of a different generic type since it does not relate to a deflaking apparatus. In addition, it does not accomplish the present object since it does not contain any means for removing dirt particles having a heavy specific weight before the fibrous suspension enters an annular space between a rotor and a screen.

A further apparatus of a different generic type (DE-38 20 366-A), in which the fibrous suspension is also not deflaked, relates to an apparatus for sorting cellular material which has an approximately circular-cylindrical housing with a horizontal axis and a rotor arranged concentrically to the housing. The fibrous suspension to be processed is introduced paraxially into the apparatus at one housing end, namely into a chamber formed by the housing wall which is closed around its circumference. A first rotor region designed as a toothed wheel is located in this chamber and followed by a second, circular-cylindrical rotor region which forms, directly behind the toothed wheel, a narrow annular gap with a housing partition wall, the external diameter of the gap being smaller than the external diameter of the toothed wheel. Rib-like vanes extending in axial direction are placed on the second rotor region. A first area of said second rotor region on the inlet side is surrounded by a region of the housing wall designed as a screen so that the fibrous suspension is sorted in this region whereas a second area of the second rotor region remote from the apparatus inlet is surrounded by a closed area of the housing wall into which a rejected material outlet opens from above the region of the screen, a diluting water connection leads through the screen. The toothed wheel is intended to be designed such that undesired solid dirt particles are hit by the toothed wheel and catapulted back in a radial direction towards the outside as well as in the direction towards the apparatus inlet in order to prevent the dirt particles from entering the annular gap located behind the toothed wheel. However, DE-38 20 366-A expressly points out that the major portion of the impurities occurring in the fibrous suspension passes through the apparatus and leaves the apparatus with the rejected material. In addition, this known apparatus has no rejected material thickening region. To summarize, it can be said that it is inconceivable to process fibrous suspensions recovered from very dirty, mixed waste paper with this known apparatus.

It is obvious that the different rotor regions need not necessarily be formed by one and the same rotor. In addition, a further rotor region may be located in front of the first rotor region, e.g. one without take-along elements for the fibrous suspension.

The inventive apparatus is expediently designed such that all the rotor regions are formed by a single, drum-shaped rotor and all the screens by a rotationally symmetrical screen basket. In this connection it should be mentioned that DE-AS 26 11 886 of the applicant discloses an apparatus for sorting, deflaking and re-screening a fibrous suspension which comprises a drum-shaped rotor arranged with its axis horizontal in a housing including a circular-cylindrical screen. One end of the housing is provided with an inlet for the fibrous suspension to be processed, the other end with a rejected material outlet and, inbetween, the housing has an accepted material outlet in the bottom and at the top, next to the rejected material outlet, a diluting water connection. The rotor is provided at its periphery in first and third rotor regions adjacent the inlet and rejected material outlet, respectively, with strip-like take-along elements for the fibrous suspension, these elements extending parallel to the rotor axis, and in a second rotor region arranged between the first and third rotor regions it bears at its periphery a gear-type collar, the teeth of which effect deflaking of the fibrous suspension. In this known apparatus, therefore, all the dirt particles, including those having a heavy specific weight which cause a considerable amount of wear and tear, pass between the rotor and the screen cylinder and the rejected material leaving the apparatus comprises a relatively large amount of water as a result of the diluting water inlet in the region of the third rotor region.

In a preferred embodiment of the inventive apparatus, a rotor region designed as a fiber washing out region is provided between the sorting region and the rejected material thickening region, this washing out region being surrounded by an annular screen and having associated with it a washing water inlet directed against the rotor. In this region, the usable fibers are washed out of the deflaked fibrous suspension and pass through the screen surrounding this rotor region as accepted material and so the rejected material leaving the apparatus is, for the most part, free of fibers.

Since the inventive apparatus is preferably a pressureless sorting apparatus, it is recommended that the rotor be provided at its periphery in the sorting region and the fiber washing out region, respectively, with take-along elements for the fibrous suspension which force the latter against the respective screen. If these take-along elements are designed to have sharp edges they also result in a deflaking effect, and in the fiber washing out region they promote the distribution of the washing water and the washing out of the usable fibers from the rejected material.

The take-along elements are particularly effective when they are designed as webs or sheets projecting in the manner of vanes from the rotor periphery.

Since the process of deflaking or defibering undissolved conglomerates of fibers essentially takes place between the elevations at the rotor periphery and the edges of the screen apertures and is attributable to an impact and shearing force on the fiber conglomerates, the deflaking effect is essentially dependent on the radial distance of the elevations and webs, respectively, from the respective screen. In preferred embodiments of the inventive apparatus, the radial distance of the webs from the respective screen is approximately ½ to approximately 5 mm and preferably ½ to approximately 1 mm. Particularly advantageous embodiments are those in which the webs are adjustable in their height relative to the rotor periphery.

In order to separate out the dirt particles having a heavy specific weight with the lowest possible energy requirements—the fibrous suspension to be processed flows into the apparatus housing at a certain geodetic water column height, which is, in particular 1 to 4 m WS (=water gage)—, the apparatus inlet for the fibrous suspension to be processed is, in an advantageous embodiment, aligned approximately tangentially and the rotor is drivable in the direction of the inlet flow so that the inlet flow already leads to a rotatory flow of the fibrous suspension between rotor and housing wall. When the take-along elements of the first rotor region and the annular space following the latter between the sorting region and the screen surrounding this sorting region are designed and arranged accordingly, it is possible in accordance with the invention for dirt particles having a heavy-specific weight to essentially not come into contact with the take-along elements of the first rotor region and for the fibrous suspension to be able to enter the specified annular space essentially unhindered, additional features which distinguish the inventive apparatus quite appreciably from the known apparatus of a different generic type according to DE-38 20 366-A.

In principle, it would be conceivable to surround the rotor region effecting deflaking with a closed wall, which comprises, for example, projections promoting the deflaking process. In view of the deflaking mechanism described above, preferred embodiments of the inventive apparatus have an annular screen surrounding the deflaking rotor region so that deflaking and sorting can take place in the same region.

Since fleece-like fiber collections can form on the feed side of the screens if no special measures are take, and these collections hinder the sorting effect, it is recommended that the take-along elements arranged at the rotor rotate as close as possible to the pertinent screen. An additional measure for preventing clogging of the screen apertures is to associate washing water inlets with the screen of the sorting region for cleaning the screen apertures.

The different screens can have screen apertures of the same size and shape. It is, however, more advantageous for the screen of the sorting region to be provided with finer screen apertures than the screen of the fiber washing out region so that, on the one hand, an accepted material having as high a quality as possible is first obtained and, on the other hand, all the usable fibers are, as far as possible, passed through the screen in the washing out region. Finally, when it comes to thickening the rejected material, i.e. withdrawing only water therefrom, finer screen apertures can again be used so that, in a preferred embodiment, the screen of the rejected material thickening region has finer screen apertures than the screen of the washing out region.

The length of time the fibrous suspension to be processed remains in the various regions of the apparatus depends on the quantity supplied per time unit, the amounts of washing water supplied per time unit, the inclination of the webs relative to the rotor axis and the speed of rotation of the rotor. For this reason it is recommended that the webs be constructed so as to be adjustable in their inclination relative to a generatrix of the rotor periphery. Since, in the first rotor region, the centrifugal effect achieved is intended to be as great as possible and the fibrous suspension located in this region is displaced anyway by the fresh fibrous suspension flowing in behind it, it is recommended that the webs in the first rotor region extend approximately parallel to the generatrices of the rotor periphery whereas the webs in the rotor regions following this first rotor region can be inclined relative to the generatrices of the rotor periphery such that they result in a conveying effect in the direction towards the rear housing end.

In order to remove the rejected material, which is as dry as possible, from the region between rotor and last screening region, a preferred embodiment of the inventive apparatus has the webs of the last rotor region projecting beyond its screen rearwardly into a rejected material chamber formed by the housing so that the rejected material is catapulted from the rotor into this chamber.

Additional features, advantages and details of the invention result from the attached drawings and the following description of a particularly favourable embodiment of the invention apparatus; in the drawings.

Figure 1:
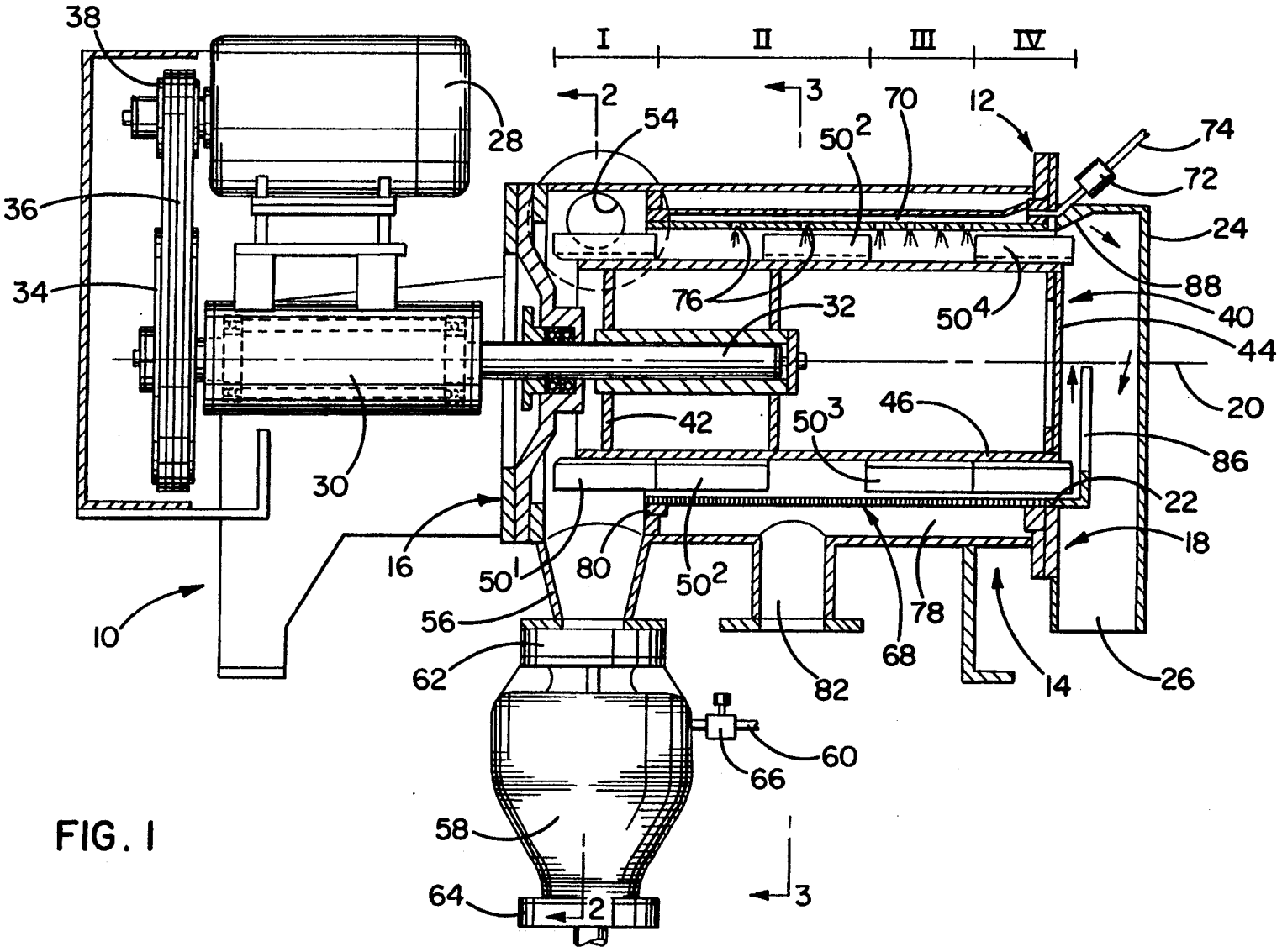
FIG. 1 is an axial section through the apparatus.

FIG. 1 shows a housing mounted on a frame 10 and designated as a whole as 12. This housing has an outer housing casing 14 and is closed by an end wall 16 to the left according to FIG. 1. A right-hand end wall 18 has an opening 22 concentric to an axis 20 and bears a rejected material box 24 which has at the bottom an exit opening 26 for the rejected material.

Figure 2:
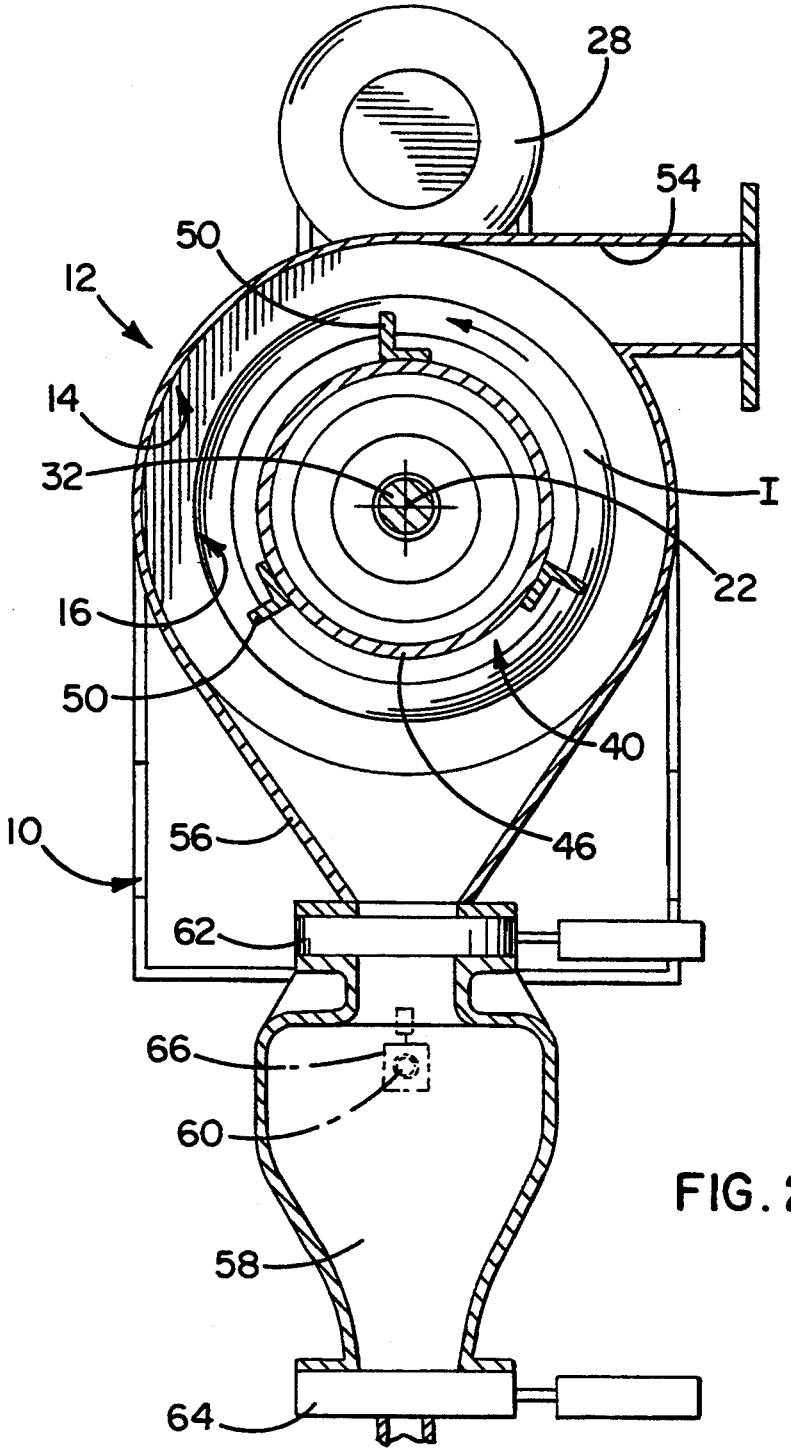
FIG. 2 is a section along line 2—2 in FIG. 1.

The frame 10 also bears a drive motor 28 and a bearing body in which a rotor shaft 32 is rotatably mounted. This is concentric to the apparatus axis 20, bears a belt pulley 34 and is caused to rotate via this, drive belt 36 and a belt pulley of the motor 28, and in a counterclockwise direction according to FIGS. 2 and 3. A hollow, circular-cylindrical rotor 40 is attached to the rotor shaft 32. At its ends this rotor is closed by end walls 42 and 44 and it has a casing 46, on which a total of 4 sets of vanes $50^1$, $50^2$, $50^3$ and $50^4$ are attached these vanes serving to take along, i.e. accelerate in a rotatory manner, the fibrous suspension to be processed. These sets of vanes $50^1$ to $50^4$ are associated with 4 regions I, II, III, IV of the apparatus or rather the rotor 40, namely—according to FIG. 1 from left to right—a hearty component separating region I, a sorting and deflaking region II, a washing out region III and a dewatering region IV. In this respect, vanes of the set of vanes $50^2$ of the sorting and deflaking region II which are adjacent one another in the circumferential direction are offset relative to one another in axial direction due to their axial length, as is apparent from FIG. 1.

A tangentially oriented inlet pipe 54 for the fibrous suspension to be processed opens into the housing 12 in the heavy component separating region I; in accordance with the invention this inlet pipe is arranged on top of the housing. In the region I the rotor 40 is enclosed only by the outer housing casing 14, into the bottom of which a vertically oriented outlet pipe 56 for dirt particles having a heavy specific weight opens. This is followed by a heavy component container 58, to which a diluting water line 60 is connected. Valves closing the heavy component container 58 at the top and bottom are designated 62 and 64, a valve for the diluting water line 60 has been designated 66.

Figure 3:
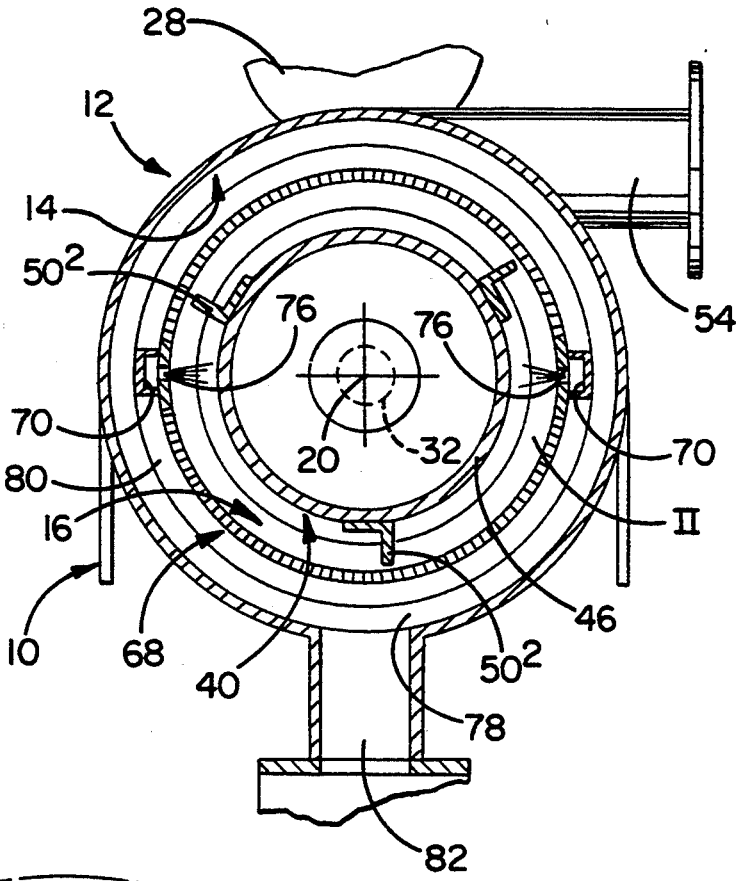
FIG. 3 is a section along line 3—3 in FIG. 1.

Along the regions II, III and IV the housing 12 accommodates a circular-cylindrical screen cylinder 68, the screen apertures of which are finer in the sorting and deflaking region II and in the dewatering region IV than in the washing out region III. As illustrated in FIGS. 1 and 3, washing water channels 70 are attached to the outside of the screen cylinder 68, these channels being supplied via a washing water conduit 74 provided with a valve 72. The screen cylinder 68 does not have any screen apertures beneath the washing water channels 70 extending in the direction of the apparatus axis 20 but only spray openings 76 at certain points, according to the invention only in the sorting and deflaking region II as well as in the washing out region III, whereas no washing water is supplied to the dewatering region IV.

An accepted material chamber 78 limited by the screen cylinder 68 and the outer housing casing 14 is, according to FIG. 1, closed on the right by the end wall 18 and on the left by a circular housing web 80; an accepted material outlet pipe 82 opens into the accepted material chamber 78 from below.

According to the invention, measures are taken to ensure that the rejected material conveyed to the rejected material box 24 cannot conglomerate but leaves the rejected material box at the bottom through its exit openings 26. For this purpose, the vanes $50^4$ of the rotor 40 project somewhat into the rejected material box 24, a guiding wall 86 in the shape of a half shell is associated with the lower region of the rotor 40 in the rejected material box 24 and at the top, adjacent the rotor, a baffle 88 is arranged in the rejected material box and this has the effect that the rejected material catapulted upwards is, according to FIG. 1, reflected towards the bottom right and therefore falls downwards into the exit opening 26 to the right of the guiding wall 86.

The fibrous suspension flowing into the apparatus via the inlet pipe 54 is caught by the vanes $50^1$ attached to the rotor in the heavy component separating region I and catapulted against the outer housing casing 14. The dirt particles in the fibrous suspension having a heavy specific weight slide downwards along the outer housing casing 14 due to the force of gravity; at the lowest point of the housing 12 they pass into the heavy component container 58 via the outlet pipe 56. A thickening of the rejected material in the hearty component container 58 is avoided by a counterwashing via the diluting water line 60.

In the heavy component separating region I the fibrous suspension to be processed is, therefore, freed of dirt particles having a heavy specific weight, such as metal parts and the like, before it enters the annular space between the rotor 40 and the screen cylinder 68.

In the sorting and deflaking region II the fibrous suspension is caught by the vanes $50^2$ and catapulted against the perforated screen cylinder 68, the screen apertures of which allow the accepted material, i.e. the fine fraction formed of usable fibers and water, to pass whereas the dirt is retained in the annular space between rotor and screen cylinder. The accepted material leaves the accepted material chamber 78 via the accepted material outlet pipe 82.

Due to the inventive design of the vanes $50^2$ with sharp edges fibers, i.e. fiber conglomerates, contained in the fibrous suspension are broken up; a slightest possible distance between the vanes $50^2$ and the screen cylinder 68 has the same effect, whereby an additional advantage is also obtained: The fibers tend to form a fiber fleece on the inner inflow side of the screen cylinder 68 and this would hinder the flow of the accepted material through the screen cylinder. The fact that the vanes $50^2$ rotate at such a slight distance from the screen cylinder 68 prevents the formation of such a fiber fleece or removes any fiber fleece in the process of formation.

Figure 4:
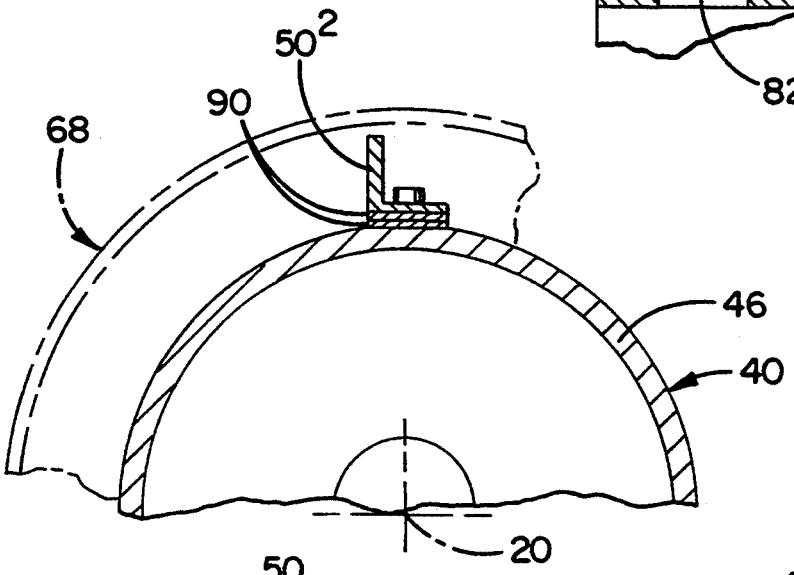
FIG. 4 is a section through part of the rotor, namely a section at right angles to the rotor axis.

As is apparent from FIG. 4, the effective height of the vanes $50^2$ may be adjusted or precluded, e.g. by the washers 90 illustrated in FIG. 4. The same applies for the other vanes. This can influence the intensity of the deflaking operation effected by the vanes $50^2$ and which is performed between the vane edges and the edges of the screen apertures by impact and shearing effects.

Figure 5:
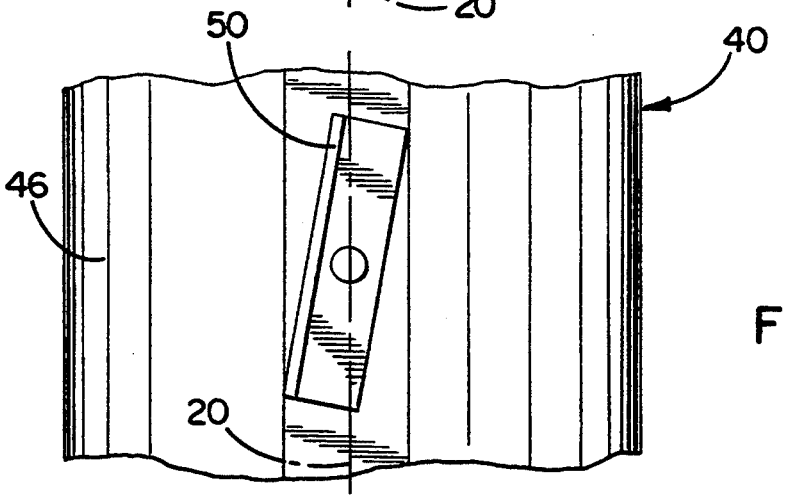
FIG. 5 is a plan view onto part of the rotor periphery.

As indicated in FIG. 5, the inclination of the vanes relative to the apparatus axis 20 or the generatrix of the rotor 40 may be adjusted. In this way, the fibrous suspension or the dirt can be transported more quickly or more slowly through the annular space between rotor 40 and screen cylinder 68 to the end of the screen cylinder to the right according to FIG. 1. In the heavy component separating region I the vanes $50^1$ are preferably axially arranged, i.e. without any angular pitch, since the axial transport of the fibrous suspension in the direction of the rejected material box 24 is effected by the fibrous suspension flowing in behind.

The screen cylinder apertures are cleaned, inter alia, by the washing water supplied via the washing water channels 70 and the spray openings 76.

Since the major portion of the individual fibers suspended in the water has passed through the screen cylinder apertures, the rejected material in the washing out region II is supplied with an increased amount of washing water in order to wash the usable fibers still contained in the rejected material off the dirt and then centrifuge them out of the annular space between rotor and screen cylinder by means of the vanes $50^3$. In the inventive apparatus the washing out process is particularly intensive since the jets of water entering the annular space between screen cylinder 68 and rotor 40 strike the rotor casing 46, are then reflected and thereby spray apart. In addition, the washing and diluting water is well distributed by the rotating vanes $50^3$. These vanes $50^3$ are, with respect to their angle, mounted on the rotor in accordance with the desired holding time in the washing out region III.

The rejected material remaining in the annular space between rotor 40 and screen cylinder 68 is now freed of the adherent water in the dewatering region IV by means of centrifugation with the aid of the vanes $50^4$ The vanes $50^4$ are according to the invention, formed of one piece over the entire length of the dewatering region IV.

The dewatered rejected material leaves the apparatus via the exit opening 26 of the rejected material box 24.

If the fibrous suspension or the rejected material are intended to remain a particularly long time in a particular region, despite the fibrous suspension flowing in behind, the vanes in this region are negatively pitched, i.e. such that they act in the sense of a return effect.

We claim:

1. An apparatus for sorting and deflaking fibrous suspension, comprising:

at least one annular screen;

a housing accommodating said screen and having a first and a second housing end region, said housing including an inlet for the fibrous suspension to be processed being disposed proximate said first housing end region, an accepted material outlet for receiving a sorted suspension portion passed through said screen, and a rejected material outlet for receiving a rejected suspension portion not passed through said screen, said rejected material outlet being disposed proximate said second housing end region;

rotor means mounted within said housing for rotation about a substantially horizontal rotor axis for sorting and deflaking fibrous suspension, said rotor means having (a) a first rotor region facing said first housing end region with projections for circulating the suspension to be processed, said first rotor region being surrounded by an annular housing wall section with a bottom zone having an outlet opening, said projections centrifuging impurity particles having at least a predetermined specific weight against said annular housing wall section;

(b) a last rotor region facing said second housing end region with projections disposed at a periphery of the last rotor region for circulating said rejected suspension portion in an annular chamber between the last rotor region and a portion of said screen surrounding said last rotor region for draining the rejected suspension portion; and (c) an intermediate rotor region for sorting the fibrous suspension and for deflaking and disintegration of fiber agglomerations contained in the fibrous suspension to be processed, said intermediate rotor region having projections disposed at a periphery of the intermediate rotor region for effecting deflaking and disintegration of fibre agglomerations and being surrounded by a portion of said screen which has an inlet side facing said intermediate rotor region and an outlet side which is in communication with said accepted material outlet.

2. Apparatus as claimed in claim 1, wherein said annular housing wall section is closed except for said inlet and said outlet openings.

3. Apparatus as claimed in claim 1, further comprising a next-to-last rotor region for washing fibers out of said fibrous suspension, said next-to-last rotor region and having associated with it a washing water inlet directed against said rotor means.

4. Apparatus as claimed in claim 1, wherein said intermediate rotor region projections circulate said fiber suspension between the intermediate rotor region and said annular screen surrounding the intermediate rotor region.

5. Apparatus as claimed in claim 3, wherein said next-to-last rotor region is provided with projections disposed at a periphery of the next-to-last rotor region for circulating the fibre suspension between said next-to-last rotor region and the annular screen surrounding said next-to-last rotor region.

6. Apparatus as claimed in claim 5, wherein said projections of said first, intermediate, next-to-last or last rotor regions are in a form of webs projecting from a respective rotor region periphery.

7. Apparatus as defined in claim 6 wherein the radial distance between said webs of the intermediate, next-to-last and last rotor regions and said screen is approximately $\frac{1}{2}$ to 5 mm.

8. Apparatus as defined in claim 7 wherein said radial distance between said webs of the intermediate next-to-last, and last rotor regions and said screen is approximately $\frac{1}{2}$ to 1 mm.

9. Apparatus as defined in claim 6 wherein the height of said webs relative to a respective rotor region periphery is adjustable.

10. Apparatus as claimed in claim 1, wherein said housing inlet for the fibrous suspension to be processed is aligned approximately tangentially in order to produce a directed inlet flow and wherein said rotor means is driven in the direction of said inlet flow, and wherein said projections of said first rotor region as well as an axially adjacent annular chamber between said third rotor region and said annular screen portion surrounding said third rotor region are structured and arranged such that impurity particles with said predetermined specific weight substantially avoid contact with the projections of said first rotor region so that said fibrous suspension can enter said annular space essentially unhindered.

11. Apparatus as defined in claim 1, wherein said annular screen surrounding said intermediate rotor region includes an inlet side facing said first rotor region and an outlet side being in communication with said accepted material outlet.

12. Apparatus as claimed in claim 1, wherein washing water inlets are structured and arranged in the annular chamber formed by the intermediate rotor region and the annular screen surrounding said intermediate rotor region.

13. Apparatus as claimed in claim 3, wherein the annular screen associated with said intermediate rotor region has finer screen apertures than the annular screen of said last rotor region.

14. Apparatus as claimed in claim 5, wherein the annular screen associated with the last rotor region has finer screen apertures than the annular screen associated with the next-to-last rotor region (III).

15. Apparatus as claimed in claim 6, wherein said webs of said first rotor region extend approximately parallel to said rotor axis.

16. Apparatus as claimed in claim 6, wherein said webs of the rotor regions, arranged downstreams of said first rotor region are inclined relative to said rotor axis for providing a conveying effect in the direction towards said second housing end region.

17. Apparatus as defined in claim 6, wherein said webs of said last rotor region project in the direction of said rotor axis beyond the annular screen associated with said last rotor region rearwardly into rejected material chamber formed by said housing.

18. Apparatus as claimed in claim 1, wherein said inlet is arranged in an upper zone of the housing wall section surrounding said first rotor region.

19. Apparatus as claimed in claim 6, wherein said webs of at least said first rotor region extend at least substantially over the entire axial length of said first rotor region.

20. Apparatus as claimed in claim 1, wherein said rotor means has a drum with a closed circumferential wall on which said projections are arranged.

21. Apparatus for sorting and deflaking fibrous suspension, comprising:

at least one annular screen;

an annular housing including first and second end segments and an intermediate segment, an inlet for receiving the fibrous suspension disposed in said first end segment, a first rejected material outlet disposed in said first end segment, an accepted material outlet disposed in said intermediate segment, and a second rejected material outlet disposed in said second end segment, said intermediate segment and said second end segment receiving said annular screen; and a rotor assembly disposed within said housing about an axis for rotation having (a) a separating rotor region facing said first housing end segment including projections for circulating the suspension received from the inlet and passing at least a portion thereof, said projections centrifuging impurity particles having at least a predetermined specific weight toward said first rejected material outlet;

(b) an intermediate rotor region facing said intermediate housing segment for receiving the suspension portion from said separating rotor region, said intermediate rotor region having projections disposed at a periphery thereof proximate said screen for deflaking and disintegrating fiber agglomerations through said screen to said accepted material outlet and for passing at least a portion of the suspension inhibited by said screen; and (c) a dewatering rotor region facing said second end segment including projections disposed at a periphery of the dewatering rotor region for receiving and circulating the suspension portion received from said intermediate rotor region and for passing a drained suspension portion to said second rejected material outlet.

22. The invention of claim 21 wherein said rotor assembly comprises a rotor extending substantially between the first and second end segments.

23. The invention of claim 21 wherein said rotor assembly comprises a plurality of axially aligned rotors extending substantially between said first end segment and said second end segment.

24. The invention of claim 21 wherein said at least one screen comprises a first screen disposed proximate said intermediate rotor region and a second screen disposed proximate said dewatering rotor region.

25. The invention of claim 21 wherein said at least one screen comprises a screen extending substantially between said first end segment and said second end segment.

26. The invention of claim 21 further comprising:

a washing-out rotor region disposed between said intermediate rotor region and said last rotor region, said washing-out rotor region removing reusable fiber from the suspension portion inhibited by said screen, and passing the suspension portion inhibited by said screen to said dewatering rotor region.

* * * * *

UNITED STATES PATENT AND TRADEMARK OFFICE

CERTIFICATE OF CORRECTION

PATENT NO. : 5,358,637

DATED : OCTOBER 25, 1994

INVENTOR(S) : HAGEN HUTZLER AND ERICH CZERWONIAK

It is certified that error appears in the above-identified patent and that said Letters Patent is hereby corrected as shown below:

Column 1, line 46, after "side with a" insert -- larger --;

Column 4, line 16, after "from above" insert -- . In --;

Column 7, line 4, after "body" insert -- 30, --;

Column 7, line 7, after "pulley" insert -- 38 --;

Column 7, line 12, after "attached" insert -- , --;

Column 7, line 17, and Column 8, line 15, "hearty" should read -- heavy --; and

Column 10, line 12, after "rotor region" insert -- being disposed between said intermediate rotor region and said last rotor region and surrounded by a portion of said screen --;

UNITED STATES PATENT AND TRADEMARK OFFICE

CERTIFICATE OF CORRECTION

PATENT NO. : 5,358,637

DATED : OCTOBER 25, 1994

INVENTOR(S) : HAGEN HUTZLER AND ERICH CZERWONIAK

It is certified that error appears in the above-indentified patent and that said Letters Patent is hereby corrected as shown below:

Column 11, line 9, after "regions" delete ","; and

Column 11, line 16, after "rearwardly into" insert -- a --.

Signed and Sealed this

Fourteenth Day of November, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. :5,358,637

DATED :OCTOBER 25, 1994

INVENTOR(S) :HAGEN HUTZLER AND ERICH CZERWONIAK

It is certified that error appears in the above-identified patent and that said Letters Patent is hereby corrected as shown below:

Column 10, line 35, after "intermediate", insert -- , --.

Signed and Sealed this

Nineteenth Day of December, 1995

Bruce Lehman

*Attest:*

BRUCE LEHMAN

*Attesting Officer*

*Commissioner of Patents and Trademarks*